US009316988B2

(12) United States Patent
Hayashi

(10) Patent No.: US 9,316,988 B2
(45) Date of Patent: Apr. 19, 2016

(54) ROTARY POWER TRANSMISSION MECHANISM FOR TRANSMITTING ROTARY POWER FROM A SHAFT TO A CYLINDRICAL MEMBER WHILE SUPPRESSING SHIFTING OF THE CYLINDRICAL MEMBER DURING ROTATION, AND PHOTORECEPTOR DRUM DEVICE, DEVELOPING DEVICE, FIXING DEVICE, AND IMAGE FORMING DEVICE PROVIDED WITH THE ROTARY POWER TRANSMISSION MECHANISM

(71) Applicant: Konica Minolta, Inc., Tokyo (JP)

(72) Inventor: Hideji Hayashi, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 12 days.

(21) Appl. No.: 14/163,283

(22) Filed: Jan. 24, 2014

(65) Prior Publication Data

US 2014/0212174 A1 Jul. 31, 2014

(30) Foreign Application Priority Data

Jan. 30, 2013 (JP) ..... 2013-015890

(51) Int. Cl.
*G03G 15/00* (2006.01)

(52) U.S. Cl.
CPC ..... *G03G 15/757* (2013.01)

(58) Field of Classification Search
CPC ..... G03G 15/757
See application file for complete search history.

(56) References Cited

U.S. PATENT DOCUMENTS 5,848,334 A * 12/1998 Kamola ..... F16D 1/101 399/167
6,490,426 B1 * 12/2002 Zaman ..... F16D 1/10 399/117

(Continued)

FOREIGN PATENT DOCUMENTS

CN 101878374 A 11/2010
JP 04-247465 3/1992

(Continued)

OTHER PUBLICATIONS

English machine translation of JP2002182527A; Yoshino, Yasushi; Sugano, Kazuhiko; Mori, Tomonori; published Jun. 26, 2002; "Photoreceptor Drum Unit, Process Cartridge, and Electrophotographic Image Forming Apparatus".*

(Continued)

*Primary Examiner* — David Gray
*Assistant Examiner* — Geoffrey Evans
(74) *Attorney, Agent, or Firm* — Lucas & Mercanti, LLP

(57) ABSTRACT

The rotary power transmission mechanism includes a flange member fitted to one end of a cylindrical member, a shaft inserted through an axial center of the flange member, and a pin member inserted through the shaft in a radial direction of the shaft. The flange member has a first contact portion and a second contact portion that have point symmetry with respect to an axial center of the shaft. When the pin member is rotated in one direction by the shaft rotating in the one direction, the first contact portion contacts a first end portion of the pin member and the second contact portion contacts a second end portion of the pin member. The pin member, when rotating in the one direction, pushes against the first contact portion and the second contact portion, rotates the flange member in the one direction, and thereby transmits rotary power to the cylindrical member.

17 Claims, 8 Drawing Sheets

(56) References Cited

U.S. PATENT DOCUMENTS

| | | | | |
|---|---|---|---|---|
| 7,043,180 | B2 * | 5/2006 | Askren | G03G 21/1676 399/167 |
| 9,176,468 | B2 * | 11/2015 | Ueno | G03G 15/757 |
| 2010/0193318 | A1 | 8/2010 | Hundrieser | |
| 2011/0103837 | A1 * | 5/2011 | Toyoda | G03G 15/751 399/174 |

FOREIGN PATENT DOCUMENTS

| | | | |
|---|---|---|---|
| JP | 07-319329 | A | 12/1995 |
| JP | 2002-182527 | A | 6/2002 |
| JP | 2007-024085 | A | 1/2007 |
| JP | 2010535998 | | 11/2010 |

OTHER PUBLICATIONS

Chinese Office Action from CN201410027472.6 dated Oct. 10, 2015.*

Office Action dated Feb. 3, 2015 for the corresponding Japanese Patent Application No. 2013-015890 and its English translation.

Japanese Notification of Reasons for Refusal for JP2013-015890.

Chinese Office Action from CN201400274772.6 dated Oct. 10, 2015.

* cited by examiner

ROTARY POWER TRANSMISSION MECHANISM FOR TRANSMITTING ROTARY POWER FROM A SHAFT TO A CYLINDRICAL MEMBER WHILE SUPPRESSING SHIFTING OF THE CYLINDRICAL MEMBER DURING ROTATION, AND PHOTORECEPTOR DRUM DEVICE, DEVELOPING DEVICE, FIXING DEVICE, AND IMAGE FORMING DEVICE PROVIDED WITH THE ROTARY POWER TRANSMISSION MECHANISM

This application is based on an application No. 2013-015890 filed in Japan, the contents of which are hereby incorporated by reference.

BACKGROUND OF THE INVENTION (1) Field of the Invention

The present invention is related to a rotary power transmission mechanism for transmitting rotary power to a cylindrical member. In particular, the present invention relates to a rotary power transmission mechanism that transmits rotary power from a shaft that passes through a central area of a flange member to the flange member, which is fitted to an end portion of the cylindrical member, thus rotationally driving the cylindrical member, and to a photoreceptor drum device, developing device, fixing device, and image forming device provided with the rotary power transmission mechanism.

(2) Description of the Related Art

For example, an image terming device that forms images by the electrophotographic method, such as a photocopying machine or a printer, includes a photoreceptor drum that is a cylindrical member that is rotationally driven.

Such an image forming device usually has a structure in which the photoreceptor drum is a center around which are disposed a charging device, an exposure device, a developing device, a transfer device, and a cleaning device, in this order.

In such a structure of an image forming device, a surface of the photoreceptor drum, which is rotated, is uniformly charged by the charging device. The charged area of the photoreceptor drum is exposed to optically modulated laser light from the exposure device. A latent electrostatic image formed on the surface of the photoreceptor drum by the exposure is developed by the developing device.

The developing device has a developing roller disposed parallel to the photoreceptor drum and a predetermined gap (hereafter, "developing gap") exists between the developing device and the photoreceptor drum. The latent electrostatic image is visualized on the surface of the photoreceptor drum as a toner image by toner that is carried by a surface of the rotating developing roller and conveyed to a position facing the photoreceptor drum.

Meanwhile, a recording sheet is supplied from a paper feed device and is conveyed to a position at which the photoreceptor drum and the transfer device face each other. The toner image on the photoreceptor drum, receives the effect of an electric field generated by the transfer device, and transferred onto the recording sheet. Alternatively, in an image forming device using an intermediate transfer system, the toner image on the photoreceptor drum is temporarily transferred to an intermediate transfer body, such as an intermediate transfer belt, then transferred to the recording sheet.

Toner not transferred to the recording sheet or the intermediate transfer body and that is left on the surface of the photoreceptor drum, byproducts of electrical discharge generated by the charging process, and other such attached matter is scraped off by the cleaning device, whereby the surface of the photoreceptor drum is cleaned.

As the cleaning device, a blade cleaning system is widely used, in which one edge of a cleaning blade composed of polyurethane rubber, etc., is pressed against the surface of the photoreceptor drum, removing the attached matter by mechanical force.

The photoreceptor drum described above is rotationally driven by motive power transmitted from a rotational power source such as a motor through a motive power transmission mechanism (for example, refer to Japanese Patent Application Publication No. 2002-182527, Japanese Patent Application Publication No. 2007-24085).

A structure of a final stage of a conventional motive power transmission mechanism is explained below with reference to FIGS. 8A, 8B, 8C, 8D and 8E.

FIG. 8A is an exploded perspective view schematically showing a photoreceptor drum 200 and a final stage portion of the motive power transmission mechanism mentioned above. FIGS. 8B and 8C show the final stage portion in an assembled state, viewed in a direction along an arrow Q in FIG. 8A. FIGS. 8D and 8E are illustrations that additionally include a cleaning blade 202 and a developing roller 204 for explaining a problem with conventional technology.

As shown in FIG. 8A, a first flange member 206 made of synthetic resin is provided at one end of the photoreceptor drum 200, and a second flange member 208 made of synthetic resin is provided at another end of the photoreceptor drum 200. The first flange member 206 has a through hole 206A through the center thereof, and the second flange member 208 has a through hole 208A through the center thereof. A shaft 210 is inserted to pass through both of the through holes 206A and 208A.

In an end surface of the first flange member 206 opposite an end surface facing a center of the photoreceptor drum 200, a first slit 2061 and a second slit 2062 are formed extending outward from the through hole 206A in opposite radial directions of the first flange member 206. The first slit 2061 and the second slit 2062 have a width less than the diameter of the through hole 206A.

In the shaft 210, an insertion hole 210A is provided that passes through the shaft 210 in a radial direction of the shaft 210. The insertion hole 210A is for inserting a parallel pin 212.

According to the configuration described above, the first flange member 206 is fitted to the one end of the photoreceptor drum 200 and the second flange member 208 is fitted to the other end of the photoreceptor drum 200. The parallel pin 212 is then inserted into the insertion hole 210A of the shaft 210.

The shaft 210, into which the parallel pin 212 has been inserted, is inserted into the through hole 206A of the first flange member 206. The shaft 210 passes through the photoreceptor drum 200, and then passes through the through hole 208A of the second flange member 208.

Finally, both side portions of the parallel pin 212 that are protruding from the shaft 210 are inserted into the first slit 2061 and the second slit 2062, completing the assembly.

As shown in FIG. 8B, when an axial center of the parallel pin 212 coincides with a center of the first slit 2061 and the second slit 2062, a size of a gap d1 between the parallel pin 212 and side walls of each of the first slit 2061 and the second slit 2062 is 0.1 mm-0.2 mm. Also shown in FIG. 8B, when both ends of the parallel pin 212 protrude equally from the shaft 210, a size of a gap d2 between an end surface of the parallel pin 212 and a corresponding one of an end wall of the first slit 2061 and the second slit 2062 is 0.3 mm-0.5 mm.

According to the above configuration, when the shaft 210 is rotated in the direction indicated by an arrow P, as shown in FIG. 8C, both ends of the parallel pin 212 contact with and push against a corresponding one of a side wall of the first slit 2061 and a side wall of the second slit 2062 (a force Fa and a force Fb). The force Fa and the force Fb act together as a coupled force to rotate the first flange member 206 about an axial center of the shaft 210. Thus, the photoreceptor drum 200, which is fitted to the first flange member 206, is rotationally driven.

However, according to the conventional configuration described above, considering the ease of assembly of the parallel pin 212 and the shaft 210, and the ease of disassembly of the parallel pin 212 and the shaft 210, the parallel pin 212 is slidably inserted into the through hole 210A (a so-called "clearance fit"), and therefore the parallel pin 212 moves in an axial direction thereof during rotation. As a result, as shown in FIGS. 8D and 8E, only one end of the two ends of the parallel pin 212 contacts a corresponding one of the side wall of the first slit 2061 or the side wall of the second slit 2062, and pushes the first flange member 206 (hereafter, "single push state").

During rotation, variation in the width of the developing gap as a result of the above has been identified. This variation is thought to occur for the following reason.

At a circumferential surface of the photoreceptor drum 200, as shown in FIGS. 8D and 8E, the cleaning blade 202 presses against a location in a circumferential direction of the photoreceptor drum 200, as described above. Thus, a force Fc acts on the first flange member 206 in a tangential direction thereof, and resists rotation of the first flange member 206, and a force Fd acts on the first flange member 206 in a radial direction thereof. In such a case, the force Fd, which acts in the radial direction of the first flange member 206, deforms the first flange member 206, causing the first flange member 200 to be closer to the developing roller 204.

When in the single push state and while the first flange member 206 is undergoing one rotation, an angular position of pushing force from the parallel pin 212 on the first flange member 206 changes relative to a point at which the cleaning blade 202 presses against the photoreceptor drum 200. For example, as shown in FIG. 8D, when a pushing force FA acts in the same direction as the force Fd, the pushing force FA works with the force Fd, causing the first flange member 206 to be closer to the developing roller 204 than when the force Fd acts alone. As shown in FIG. 8E, when the pushing force FA acts in an opposite direction to the force Fd, the pushing force FA resists the force Fd, causing the first flange member 206 to be farther from the developing roller 204 than when the force Fd acts alone.

Thus, it can be considered that shifting of the photoreceptor drum 200 has a cycle corresponding to one rotation of the first flange member 206 (one rotation of the photoreceptor drum 200), causing variation in the width of the developing gap. Due to variation in the width of the developing gap, a problem occurs of darker or lighter than intended areas arising in an image formed by the image forming device.

To address this problem it may seem sufficient to adopt a configuration in which the parallel pin 212 is press-fitted to the insertion hole 210A such that the parallel pin 212 does not move in the axial direction thereof. However, this is not a realistic option since press-fitting the parallel pin 212 while adjusting the both ends of the parallel pin 212 to protrude by an equal length from the shaft 210 would be very labor-intensive and ease of assembly would be considerably reduced.

Note that the problem described above is not limited to cases in which rotary power is transmitted from a shaft to a photoreceptor drum. The problem is common to other cylindrical parts, for example, when transmitting rotary power to a developing roller that includes a developing sleeve. Furthermore, the problem is common to rotary power transmission mechanisms in general, which transmit rotary power from a shaft to a cylindrical member through a pin member and a flange member.

SUMMARY OF THE INVENTION

The current invention, in light of the problem described above, has the aim of providing a rotary power transmission mechanism that, when rotating a cylindrical member, suppresses shifting of the cylindrical member to a greater extent than the conventional technology described above, and a photoreceptor drum device, developing device, fixing device, and image forming device provided with the rotary power transmission mechanism.

In order to achieve the above aim, the rotary power transmission mechanism pertaining to the present invention comprises: a cylindrical member; a flange member fitted to one end portion of the cylindrical member, and having a through hole passing through a center of the flange member; a shaft inserted through the through hole, and having an insertion hole passing through a radial direction of the shaft, rotary power of the shaft being transmitted to the cylindrical member via tide flange member; and a pin member inserted through the insertion hole and having two end portions, which are portions of the pin member that protrude from opposite sides of the shaft, wherein the flange member has a pair of contact portions that have point symmetry with respect to an axial center of the shaft, the pair of contact portions being composed of a first contact portion and a second contact portion, and when the pin member is rotated in one direction by the shaft rotating in the one direction, the first contact portion contacts and is pushed by a first end portion of the pin member and the second contact portion contacts and is pushed by a second end portion of the pin member, the first end portion being one of the two end portions and the second end portion being the other one of the two end portions, and the pin member, when rotating in the one direction, pushes against the first contact portion and the second contact portion, rotates the flange member in the one direction, and thereby transmits rotary power to the cylindrical member.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 8A is an exploded perspective view schematically showing a photoreceptor drum and a final stage portion of a motive power transmission mechanism, FIGS. 8B and 8C show the final stage portion in an assembled state, viewed in a direction along an arrow Q in FIG. 8A, FIGS. 8D and 8E are illustrations that additionally include a cleaning blade and a developing roller for explaining a problem with conventional technology.

DESCRIPTION Of THE PREFERRED EMBODIMENTS

The following is an explanation of embodiments of the present invention, given with reference to the drawings.

<Embodiment 1>

Figure 1:
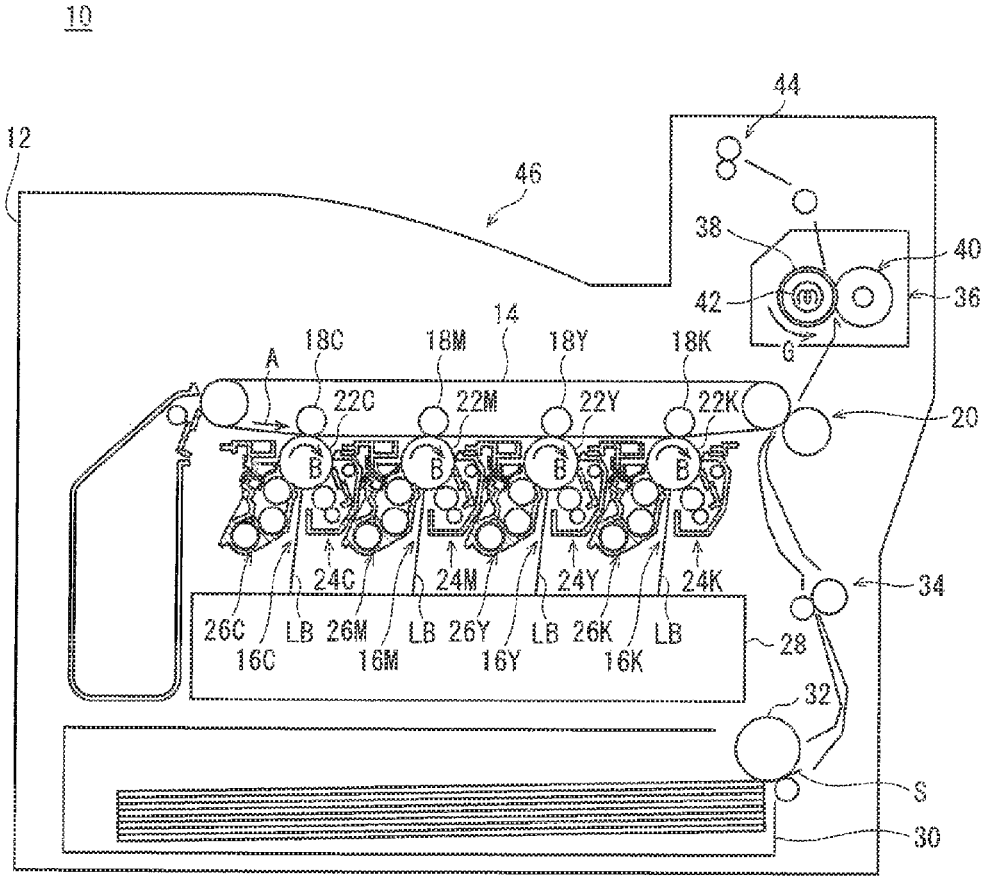
FIG. 1 is a schematic diagram illustrating a tandem type printer.

FIG. 1 is a schematic diagram illustrating a tandem type printer 10 (hereafter, "printer 10") pertaining to the present embodiment.

As shown in FIG. 1, the printer 10 includes, inside a case 12, a transfer belt 14 that is suspended horizontally and runs in the direction indicated by an arrow A, four imaging units 160, 16M, 16Y, and 16K arranged in a line along the running direction of the transfer belt 14, four first transfer rollers 18C, 18M, 18Y, and 18K, one for each corresponding imaging unit, and a second transfer unit 20. The printer 10 is a so-called intermediate transfer method image forming device, in which a toner image of each color component formed by each of the imaging units 16C, 16M, 16Y, and 16K, is temporarily transferred by being layered on the transfer belt 14, and is then transferred to a recording sheet S for forming a color image.

Each of the imaging units 16C, 16M, 16Y, and 16K has, arranged around a corresponding photoreceptor drum 22C, 22M, 22Y, and 22K, a corresponding charging unit 24C, 24M, 24Y, and 24K, and a corresponding developing unit 26C, 26M, 26Y, and 26K. Each of the photoreceptor drums 22C, 22M, 22Y, and 22K is a cylindrical member.

An exposure unit 28 is disposed below the imaging units 16C, 16M, 16Y, and 16K, and emits a laser light LB toward each of the photoreceptor drums 22C, 22M, 22Y, and 22Y. The laser light LB is optically modulated.

The photoreceptor drums 22C, 22M, 22Y, and 22K are rotated in the direction indicated by an arrow B. A surface of each of the photoreceptor drums 22C, 22M, 22Y, and 22K is uniformly charged by the corresponding charging unit 24C, 24M, 24Y, and 24K, and then exposed by the laser light LB, forming a latent electrostatic image thereon. The latent electrostatic images are then developed into toner images (visualized) by the developing units 26C, 26M, 26Y, and 26K. Note that the developing units 26C, 26M, 26Y, and 26K respectively supply toner of colors cyan (C), magenta (M), yellow (Y), and black (K) as developer to corresponding photoreceptor drums 22C, 22M, 22Y, and 22K.

The toner images formed on the photoreceptor drums 22C, 22M, 22Y, and 22K are sequentially transferred onto the running transfer belt 14 by each receiving the effect of an electric field generated between a pair of a corresponding one of the first transfer rollers 18C, 18M, 18Y, and 18K and a corresponding one of the photoreceptor drums 22C, 22M, 22Y, and 22K.

Meanwhile, the recording sheet S, which is fed from a paper feed cassette 30 by a pick-up roller 32, is carried to the second transfer unit 20 by a resist roller 34. The recording sheet S is timed to arrive at the second transfer unit 20 at the same time as the toner images on the transfer belt 14 arrive at the second transfer unit 20. The second transfer unit 20 then transfers the toner images that are layered on the transfer belt 14 to the recording sheet S The recording sheet S that has had a toner image transferred thereon is then carried to a fixing device 36. The fixing device 36 has a fixing roller 38, which is a cylindrical member, and a pressure roller 40, which is a pressing member. A heater lamp 42, which is a heat source, is housed in a hollow portion of the fixing roller 38. The fixing roller 38 rotates in the direction indicated by an arrow G, due to rotary power transmitted from a motor (not illustrated), via a power transmission mechanism (not illustrated). The pressure roller 40 is formed from a core that is made of a metal material and an elastic layer on an outer circumferential surface of the core. The elastic layer is made of silicone rubber and fluorine resin. The pressure roller 40 is in pressure contact with the fixing roller 38 due to being pressed by a pressure contact mechanism (not illustrated). A fixing nip is formed between the fixing roller 38 and the pressure roller 40 due to the pressure contact, and the pressure roller 40 is driven to rotate by the rotation of the fixing roller 38. The recording sheet S, which carries the unfixed toner image, passes through the fixing nip. The unfixed toner image is thereby fixed to the recording sheet S.

The recording sheet S that has the toner image fixed thereon is then discharged to a paper discharge tray 46 by a discharge roller 44.

Figure 2:
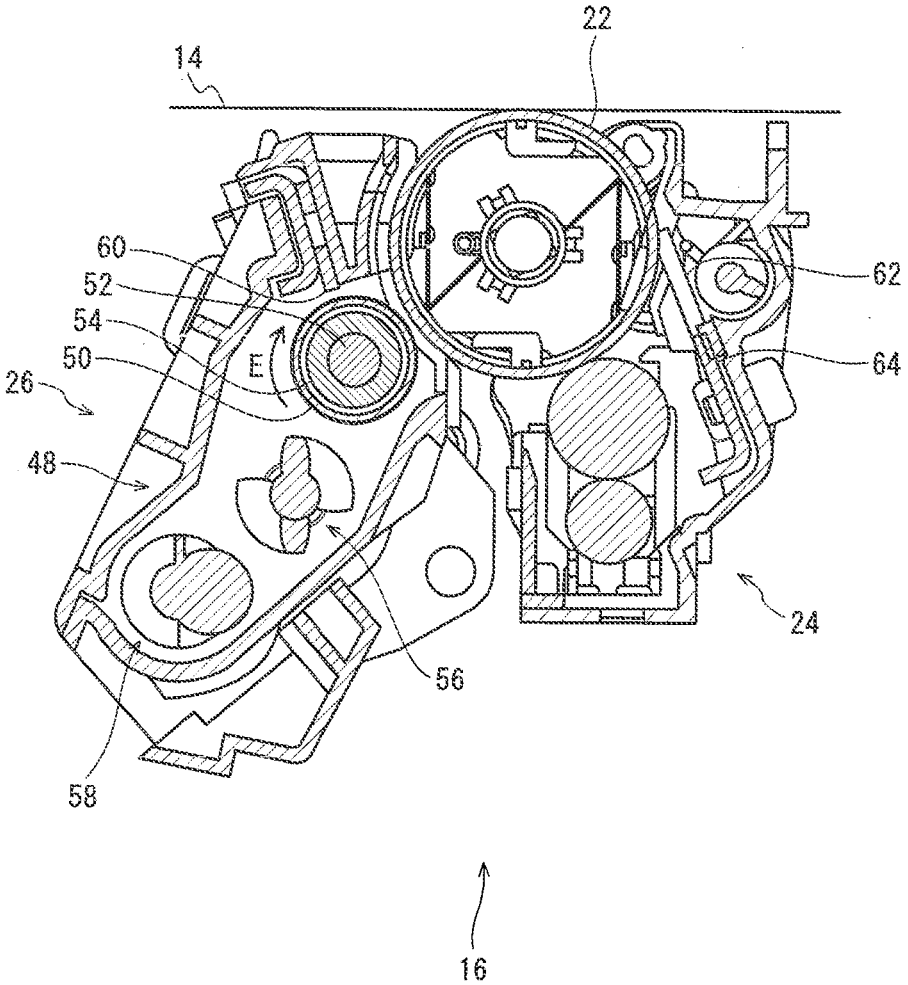
FIG. 2 is a cross-sectional view of an imaging unit included in the tandem type printer.

FIG. 2 is a cross-sectional view of an imaging unit. Note that since the four imaging units 16C, 16M, 16Y, and 16K, corresponding to the colors cyan, magenta, yellow and black, have the same structure, the explanation hereafter and accompanying drawings referred to in the explanation omit the reference symbols C, M, Y, and K.

As described above, in the imaging unit 16 the charging unit 24 and the developing unit 26 are arranged around the photoreceptor drum 22, which is a cylindrical member.

The developing unit 26 is a unit type developing device. The developing unit 26 has a developing container 48 that contains a two-component developer composed of toner and a magnetic carrier (hereafter, "developer", not shown in FIG. 2).

The developing unit 26 also has a developing sleeve 50 that is a cylindrical member. The developing sleeve 50 is provided in such a way that a portion of an outer circumference of the developing sleeve 50 is exposed from the developing container 48. The developing sleeve 50 is disposed parallel to the photoreceptor drum 22 such that a predetermined gap (development gap) exists between the developing sleeve 50 and the photoreceptor drum 22. The length of the predetermined gap is set to be, for example, 0.25 mm-0.35 mm. The developing sleeve 50 is made from a nonmagnetic material such as aluminium and austenite stainless steel, and has a thickness of 0.5 mm.

A magnet roller 54 that has a hollow cylinder shape and that is attached together with a shaft 52 as one body is disposed in a hollow portion of the developing sleeve 50. To put it another way, the developing sleeve 50 is like an over-coat for the magnet roller 54. The shaft 52 is fixed so that rotation is not possible. The magnet roller 54 is a magnet body that has a plurality of magnetic poles in a circumferential direction of the magnet roller 54.

Below the developing sleeve 50 and inside the developing container 48 is provided a first screw feeder 56 and a second screw feeder 58 that are for agitating the developer and carrying the developer to the developing sleeve 50.

Carriers that are charged by friction due to agitation by the first screw feeder 56 and the second screw feeder 58 attract toner that attaches to the carriers, and are magnetically attracted to the surface of the developing sleeve 50. Developer that is magnetically attracted to the surface of the developing sleeve and forms a brush-like formation thereon (not illustrated) is carried by the developing sleeve 50 that rotates in the direction indicated by an arrow E. Part-way through the rotation, the amount of developer carried by the developing sleeve 50 is regulated by a height regulation board 60. After regulation by the height regulation board 60, the developer is carried to an area (developing area) opposite the surface of the photoreceptor drum 22 and develops the latent electrostatic image formed on the surface of the photoreceptor drum 22. Developer that is left after development is recovered inside the developing container 48 by the rotation of the developing sleeve 50.

The toner image created on the surface of the photoreceptor drum 22 by the developing described above is transferred to the transfer belt 14 as described above.

Residual toner, etc. that is not transferred and is left on the surface of the photoreceptor drum 22 is cleaned off by a cleaning blade 62.

The cleaning blade 62 has a long and narrow rectangular shape. The cleaning 62 is fixed to a holder 64. One side edge (a long side) of the cleaning blade 62 is pressed against the surface of the photoreceptor drum 22 and scrapes off residual toner etc. The cleaning blade 62 is an elastic rubber blade. As rubber material, for example, thermosetting polyurethane rubber is used.

Figure 3:
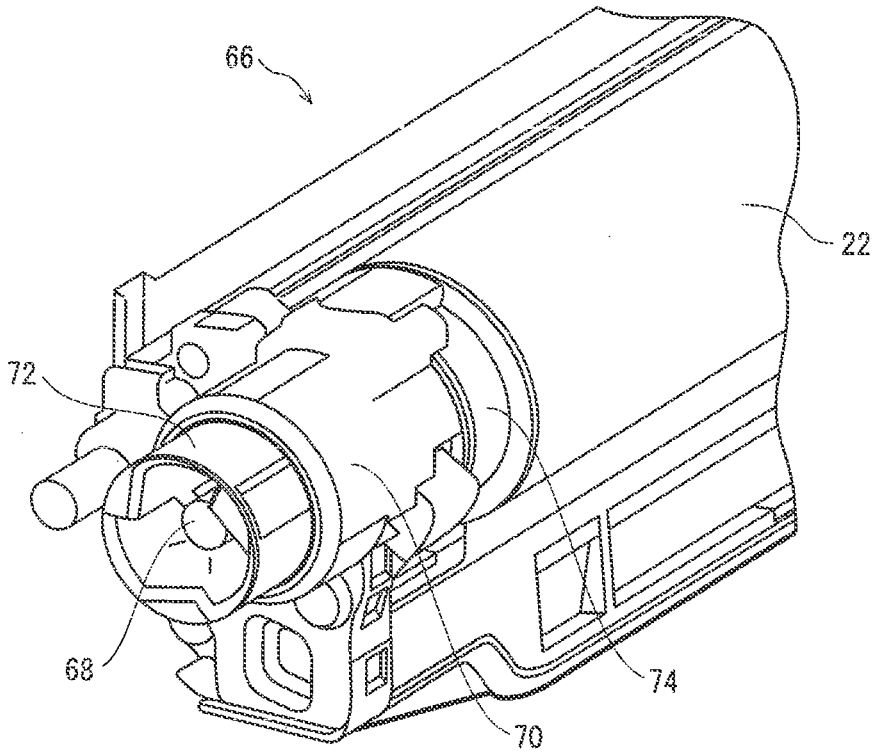
FIG. 3 is a perspective view of one end portion of a photoreceptor drum device.

FIG. 3 is a perspective view of one end portion of a photoreceptor drum unit 66 that includes the photoreceptor drum 22. The photoreceptor drum unit 66 is a unit type photoreceptor drum device that is attachable to and detachable from the printer 10.

A drum shaft 68 is inserted through the photoreceptor drum 22. The drum shaft 68 is rotatably supported by a bearing portion 70.

A coupling 72 is attached to an end portion of the drum shaft 68 as illustrated. Another coupling (not illustrated) is attached to a main body of the photoreceptor drum unit 66. Rotary power from a motor (not illustrated) is transmitted to the other coupling. When the photoreceptor drum unit 66 is attached by insertion into the main body of the device, the coupling 72 connects to the other coupling, and therefore rotary power from the main body of the device is transmitted to the drum shaft 68.

Rotary power of the drum shaft 68 is transmitted to the photoreceptor drum 22 via a flange member 74 that is fitted to one end portion of the photoreceptor drum 22.

Figure 4A:
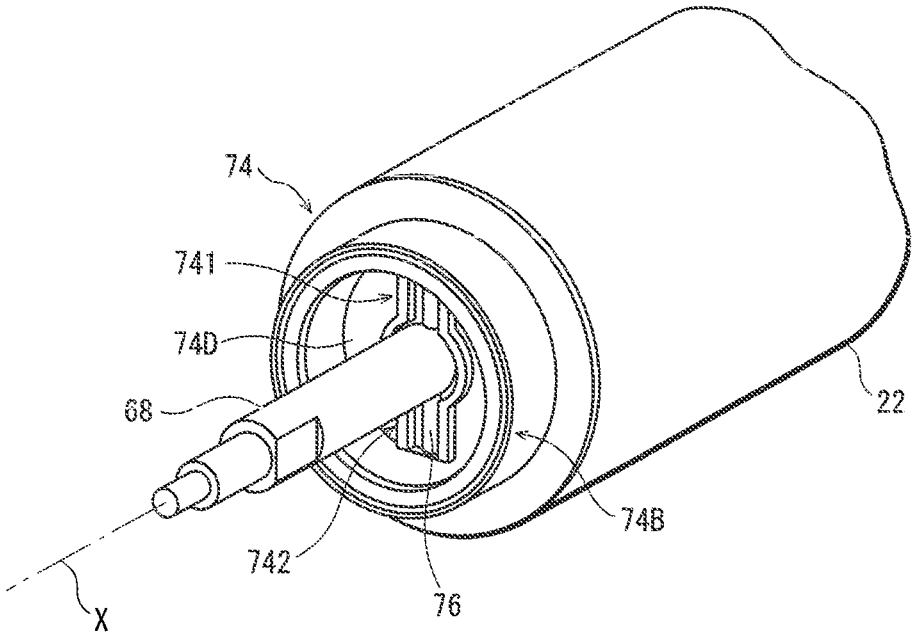
FIG. 4A is a perspective view of the photoreceptor drum, in a state in which a shaft bearing and a coupling, illustrated in FIG. 3, have been removed.
Figure 4B:
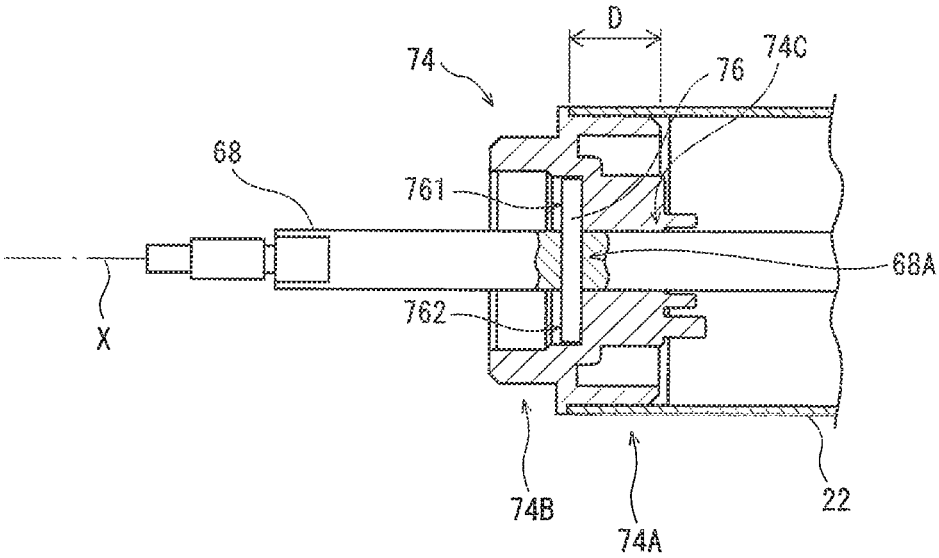
FIG. 4B is a vertical cross-sectional view of the state shown in FIG. 4A.

FIG. 4A is a perspective view of the one end portion of the photoreceptor drum 22 in FIG. 3. In FIG. 4A, the photoreceptor drum 22 has been removed from the bearing portion 70, and the coupling 72 has been removed therefrom. FIG. 4B is a cross-sectional view of the state shown in FIG. 4A.

The flange member 74 has a through hole 74C passing through a center thereof. The flange member 74 is composed of a double cylindrical portion 74A that forms the through hole 74C and a single cylindrical portion 74B that extends from the double cylindrical portion 74A. An outer cylindrical portion of the double cylindrical portion 74A is fitted into an end portion of the photoreceptor drum 22 and is fixed thereto by an adhesive that is not illustrated.

The drum shaft 68 is inserted (with clearance) into the through-hole 74C. An outer diameter of the drum shaft 68 and an inner diameter of the through-hole 74C are such that the drum shaft 68 may be easily inserted into and extracted from the through-hole 74C and, in an inserted state, the drum shaft 68 is not loose. In other words, the size relationship of the drum shaft 68 and the through-hole 74C are adjusted to achieve a so-called clearance fit.

The flange member 74 is made from a synthetic resin material with a view to weight reduction, and is formed by injection molding.

A parallel pin 76, which is a pin member, is inserted (with clearance) into an insertion hole 68A that passes through the drum shaft 68 in a radial direction thereof. An outer diameter of the parallel pin 76 and an inner diameter of the insertion hole 68A are such that the parallel pin 76 may be easily inserted into the insertion hole 68A and, in an inserted state, the parallel pin 76 is not loose. In other words the dimensions of the parallel pin 76 and the insertion hole 68A are determined so as to achieve a so-called clearance fit. In a state in which insertion is complete, two end portions of the parallel pin 76, a first end portion 761 and a second end portion 762, protrude from the drum shaft 68. The two end portions are portions of the parallel pin 76 that protrude from opposite sides of the drum shaft 68. Note that in the example drawings, both end surfaces of the parallel pin 76 are flat. However, the present invention is not limited in this way, and both end surfaces of the parallel pin may be rounded.

The inner cylindrical portion of the double cylindrical portion 74A of the flange member 74 has an end surface 74D. The end surface 74D has a first groove 741 and a second groove 742 extending in opposite radial directions with respect to the drum shaft 68. The first end portion 761 and the second end portion 762 fit into (are inside) the first groove 741 and the second groove 742, respectively.

Figure 5A:
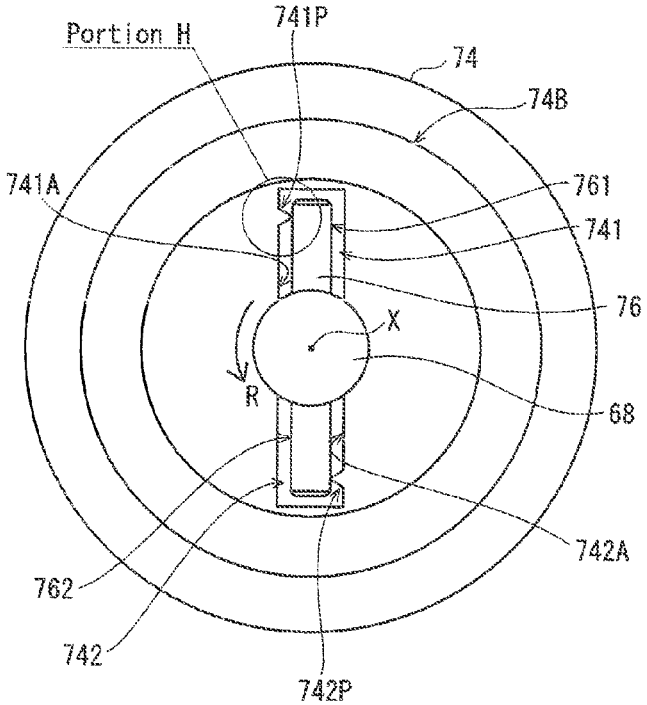
FIG. 5A is an illustration of the state shown in FIG. 4A and FIG. 4B, viewed in a direction along an axial center X of a drum shaft 68.
Figure 5C:
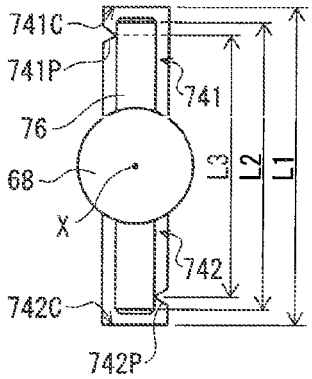
FIG. 5C is an illustration for explaining the relative dimensions of a length of a parallel pin and other portions.
Figure 5B:
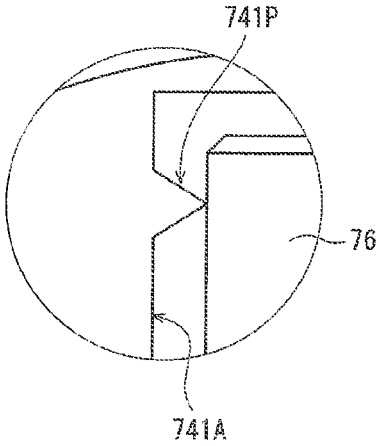
FIG. 5B is an enlargement of a portion H that is shown In FIG. 5A.

FIG. 5A is an illustration of the state shown in FIG. 4A and FIG. 4B, viewed in a direction along the axial center X of the drum shaft 68. FIG. 5B is an enlargement of a portion H that is shown in FIG. 5A. Note that to avoid complication, from FIG. 5A onward, chamfered portions of the flange member 74 that would show as double lines are shown as single lines and thereby simplified.

As shown in FIG. 5A, a protrusion portion 741P protrudes from a portion of a side wall 741A of the first groove 741, and a protrusion portion 742P protrudes from a portion of a side wall 742A of the second groove 742, at positions having point symmetry with respect to the axial center X. The protrusion portion 741P and the protrusion portion 742P protrude from side walls (the side wall 741A and the side wall 742A) that are in the direction of movement of the first end portion 761 and the second end portion 762, respectively, when the parallel pin 76 rotates about the axial center X. The parallel pin 76 rotates about the axial center X when the drum shaft 68 is rotationally driven in the direction indicated by an arrow R in FIG. 5A.

The protrusion portion 741P and the protrusion portion 742P each have a triangle shape in a transverse section. The protrusion portion 741P and the protrusion portion 742P each have a ridge shape that is elongated in a depth direction of the first groove 741 and the second groove 742. In other words, ridge lines formed by a tip portion of the protrusion portion 741A and a tip portion of the protrusion portion 742P are parallel to the axial center X.

The protrusion portion 741P and the protrusion portion 742P have point symmetry with respect to the axial center X. Thus, when rotary power is applied to the drum shaft 68, causing the parallel pin 76 to rotate, an area of a circumferential surface of the parallel pin 76 at the first end portion 761 presses against the protrusion portion 761 and an area of the circumferential surface of the parallel pin 76 at the second end portion 762 presses against the protrusion portion 742P. A pushing force thus generated acts as a coupled force that is centered about the axial center X, and acts on the flange member 74, transmitting rotary power to the flange member 74 and rotating the photoreceptor drum 22, to which the flange member 74 is fitted.

Since the force exerted on the flange member 74 by the parallel pin 76 is a coupled force, the force works entirely to rotate the flange member 74 about the axial center X, causing hardly any eccentricity in the rotation of the flange member 74 with respect to the axial center X. Thus, the present invention suppresses variation in the width of the developing gap to a greater extent than the conventional technology described above.

Using the configuration shown in FIG. 5A, an imaging unit was configured with a flange member pertaining to conventional technology that was not provided with the protrusion portion 741P and the protrusion portion 742P, and another imaging unit was configured with the flange member 74 pertaining to the present embodiment, as shown in FIG. 5A. Variation in the width of the developing gap in each of such measuring units was measured. Variation of 50 μm was observed using conventional technology, and variation of 20 μm was observed using the flange member 74 pertaining to the present embodiment.

Note that an outer diameter of the photoreceptor drums provided for the above measurement was 30 mm.

Note that since the parallel pin 76 is inserted with clearance into the insertion hole 68A of the drum shaft 68 (see FIG. 4B), there is a risk of the parallel pin 76 moving in a longitudinal direction thereof and losing contact with a protrusion portion in the direction opposite the direction of movement, unless a preventative measure is taken. However, in the present embodiment, dimensions of portions shown in FIG. 5C are set relative to each other as described below, avoiding a situation in which the parallel pin 70 moves in the longitudinal direction thereof and loses contact with the protrusion portion in the direction opposite the direction of movement.

Specifically, when

L1 denotes a distance between an end wall 741C of the first groove 741 and an end wall 742C of the second groove 742, L2 denotes a length of the parallel pin 76 (here, "length of the parallel pin 76" is a length of a straight portion of the parallel pin 76, excluding the chamfered portions of the end surfaces of the parallel pin 76), and L3 denotes a distance between the tip portion of the protrusion portion 741P and the tip portion of the protrusion portion 742P, the following relationship is satisfied:

$$((L2-L3)/2)>((L1-L2)/2)$$

By setting the dimensions of the portions described above according to the relationship described above, even if the parallel pin 76 moves in the longitudinal direction thereof to the extent that one end surface of the parallel pin 76 contacts a corresponding one of the end wall 741C and the end wall 742C, the parallel pin 76 maintains contact with the protruding portion (the protruding portion 741P or the protruding portion 742P) corresponding to the end portion of the parallel pin 76 that has an end surface not in contact with a corresponding one of the end wall 741C and the end wall 742C.

Also, in order to efficiently transmit torque of the drum shaft 68 to the flange member 74, lengths denoted by L2 and L3 are preferably such that the area of the circumferential surface of the parallel pin 76 at the first end portion 761 contacts the protrusion portion 741P, and the area of the circumferential surface of the parallel pin 76 at the second end portion 762 contacts the protrusion portion 742P at positions nearer the end surfaces of the parallel pin 76 than the center of the parallel pin 76 in the longitudinal direction thereof.

Note that reducing the width of the first groove 741 and the second groove 742 is possible, such that, when the parallel pin 76 is inserted (embedded) in the first groove 741 and the second groove 742, the protrusion portions 741P and 742P are elastically deformed. Such a configuration causes the parallel pin 76 to press against the side walls opposite the protrusion portions 741P and 742P, stopping movement of the parallel pin 76 in the longitudinal direction thereof. However, such a configuration is not desirable for the reasons described below. Firstly, during assembly, the parallel pin 76 would need to be forcibly pushed into the first groove 741 and the second groove 742, increasing assembly labor. Also, due to forcibly pushing the parallel pin 76 into the first groove 741 and the second groove 742, there would be a risk of the flange member 74, which is composed of synthetic resin, deforming, and of causing decentering of the flange member 74 with respect to the axial center X of the drum shaft 68. Thus, a problem would be introduced identical to the problem with conventional technology described above.

Figure 5D:
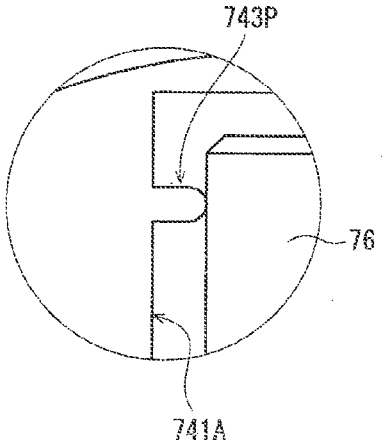
FIG. 5D is an illustration of a modification of embodiment 1.

In the above example, the transverse section of each of the protrusion portions has a triangle shape, but the present invention is not limited in this way. For example, a protrusion portion 743P may be used, as shown in FIG. 5D, a transverse section of a tip of which has a rounded shape (in the present example, an arc shape), Also, a position of the parallel pin 76 in a direction along the axial center X of the drum shaft 68 is preferably farther inside the photoreceptor drum 22 (closer to the center of the photoreceptor drum 22, farther to the right in the illustration) than shown in FIG. 4B, such that the area of the circumferential surface of the parallel pin 76 at the first end portion 761 is in contact with the protrusion portion 741P and the area of the circumferential surface of the parallel pin 76 at the second end portion 762 is in contact with the protrusion portion 742P, inside the photoreceptor drum 22. In other words, a configuration is preferable where, as shown in FIG. 4B, a portion of the flange member 74 is inserted into the photoreceptor drum 22, and the protrusion portions 741P and 742P are within an insertion area D of the flange member 74, and the parallel pin 76 contacts the protrusion portions 741P and 742P within the insertion area D. Such a configuration may be implemented by increasing the depth of the first groove 741 and the second groove 742, or by shifting the end surface 74D (refer to FIG. 4A), in which the first groove 741 and the second groove 742 are formed, farther to the right in the illustration.

In a case in which contact positions between the circumferential surface of the parallel pin 76 and the protrusion portions 741P and 742P are, in a direction along the axial center X, outside the photoreceptor drum 22, a portion of the flange member 74 between the contact positions and an end surface of the photoreceptor drum 22 twists. The twisting risks causing the photoreceptor drum 22 to shake in a radial direction thereof. However, by adopting the configuration described above, the twisting is unlikely to occur, and the shaking of the photoreceptor drum 22 as described above is suppressed accordingly.

<Embodiment 2>

Embodiment 2 is essentially the same as embodiment 1, except for a difference regarding contact portions (in embodiment 1, the protrusion portions 741P and 742P) that contact with the area of the circumferential surface of the parallel pin 76 at the first end portion 761 and the area of the circumferential surface of the parallel pin 76 at the second end portion 762. Accordingly, in embodiment 2, portions that are the same as in embodiment 1 have the same numbering, are not mentioned unless necessary, and the following explanation focuses on portions that differ from portions in embodiment 1.

Figure 6A:
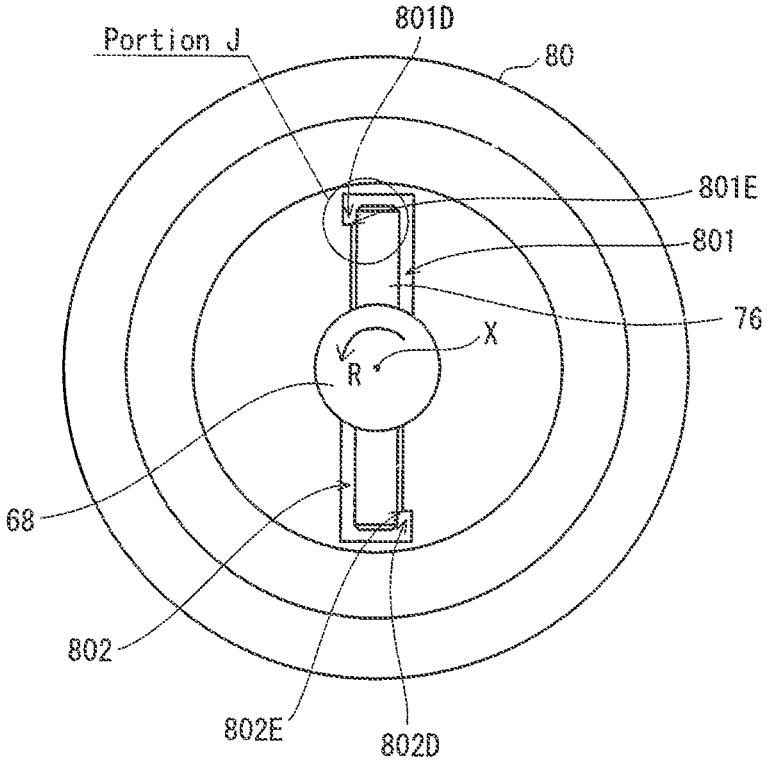
FIG. 6A is an illustration of a flange member and a parallel pin pertaining to embodiment 2, viewed in a direction along the axial center X of the drum shaft 68.
Figure 6B:
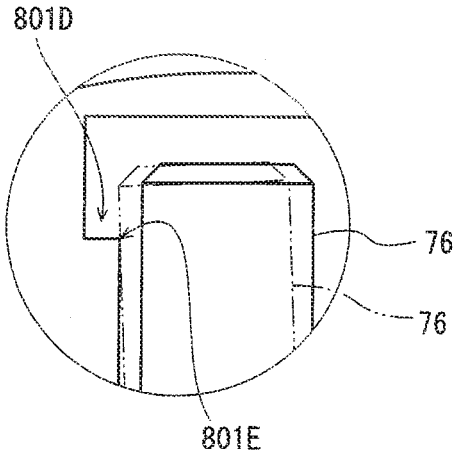
FIG. 6B is an enlargement of a portion J that is shown in FIG. 6A.

FIG. 6A is an illustration of a flange member 80 and the parallel pin 76, viewed in a direction along the axial center X of the drum shaft 68, illustrated in the same way as FIG. 5A. FIG. 6B is an enlargement of a portion J that is shown in FIG. 6A In embodiment 2, a first groove 801 and a second groove 802 extend in opposite radial directions with respect to the drum shaft 68. A stepped portion 801D and a stepped portion 802D are formed in a side wall of the first groove 801 and the second groove 802, respectively, and form the contact portions that contact the area of the circumferential surface of the parallel pin 76 at the first end portion 761 and the area of the circumferential surface of the parallel pin 76 at the second end portion 762.

The stepped portions 801D and 802D, and protruding corner portions 801E and 802E of the stepped portions 801D and 802D, respectively, are formed having point symmetry with respect to the axial center X.

When the drum shaft 68 is rotationally driven In the direction indicated by an arrow R in FIG. 6A, the parallel pin 76 rotates as shown by the line of alternating long and two short dashes shown in FIG. 6B. The area of the circumferential surface of the parallel pin 76 at the first end portion 761 contacts and pushes against the protruding corner portion 801E and the area of the circumferential surface of the parallel pin 76 at the second end portion 762 contact and pushes against the protruding corner portion 802E.

Since a pushing force thus generated is a coupled force about the axial center X, an effect identical to the effect described in embodiment 1 is obtained.

<Embodiment 3>

Figure 7A:
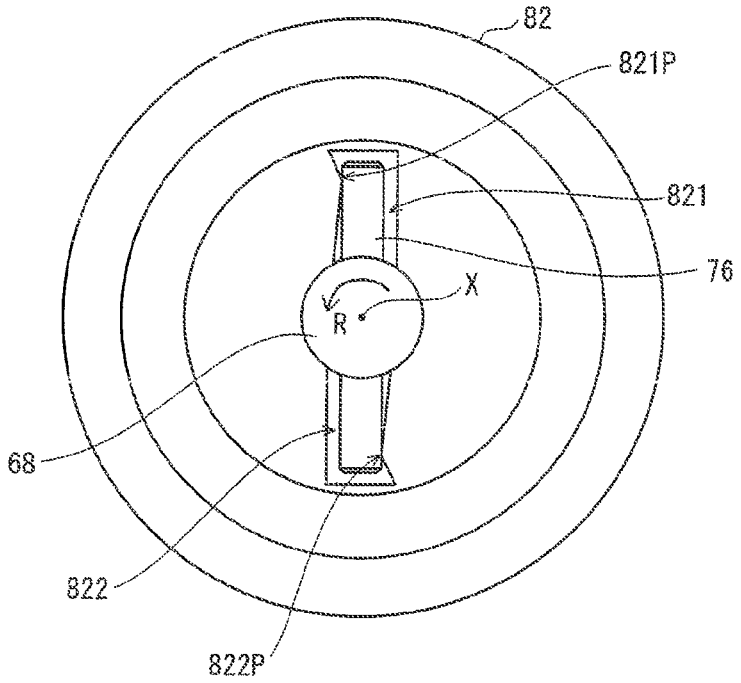
FIG. 7A is an illustration of a flange member and a parallel pin pertaining to embodiment 3, viewed in a direction along the axial center X of the drum shaft 68.

FIG. 7A is an illustration of a flange member 82 and the parallel pin 76, viewed in a direction along the axial center X of the drum shall 68, illustrated in the same way as FIG. 5A.

In embodiment 3, a first groove 821 and a second groove 822 extend in opposite radial directions with respect to the drum shaft 68. An entire side wall of the first groove 821 and an entire side wall of the second groove 822 each have a mountain shape that is elongated in a depth direction of the first groove 821 and the second groove 822, respectively. A ridge portion 821P and a ridge portion 822P of the mountain shapes form the contact portions that contact with the area of the circumferential surface of the parallel pin 76 at the first end portion 761 and the area of the circumferential surface of the parallel pin 76 at the second end portion 762.

The mountain shapes, and the ridge portions 821P and 822P of the mountain shapes, are formed having point symmetry with respect to the axial center X.

When the drum shaft 68 is rotationally driven in the direction indicated by an arrow R in FIG. 7A, the area of the circumferential surface of the parallel pin 76 at the first end portion 761 contacts and pushes against the ridge portion 821P, and the area of the circumferential surface of the parallel pin 76 at the second end portion 762 contacts and pushes against the ridge portion 822P.

Since a pushing force thus generated is a coupled force about the axial center X, an effect identical to the effect described in embodiment 1 is obtained.

<Embodiment 4>

Figure 7B:
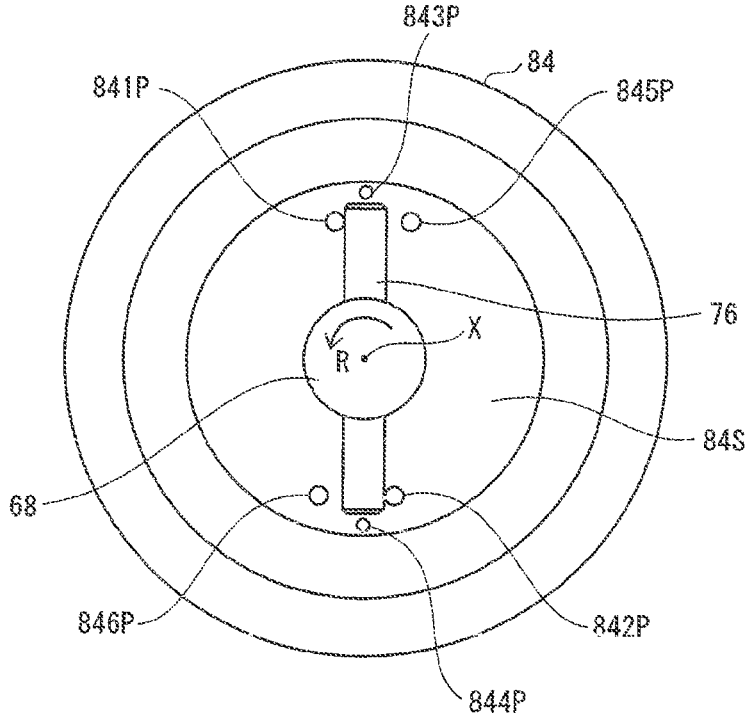
FIG. 7B is an illustration of a flange member and a parallel pin pertaining to embodiment 4, viewed in a direction along the axial center X of the drum shaft 68.
Figure 8A:
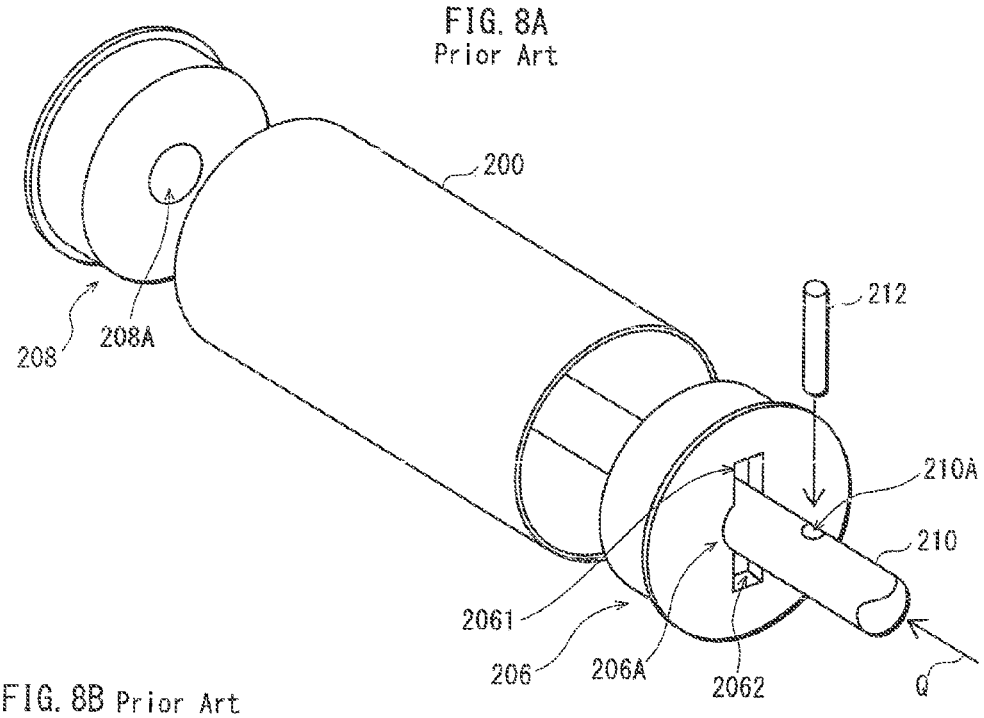
FIG. 8A Prior Art
FIGS. 8A, 8B, 8C, 8D and 8E are illustrations for explaining conventional technology.
Figure 8B:
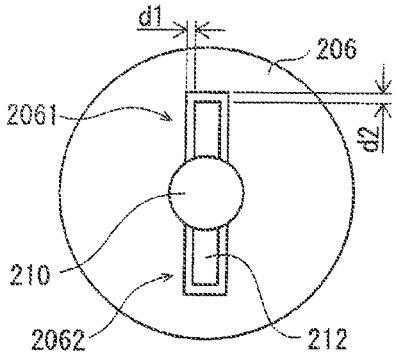
FIG. 8B Prior Art
Figure 8C:
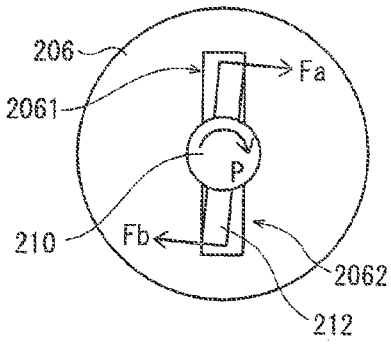
FIG. 8C Prior Art
Figure 8D:
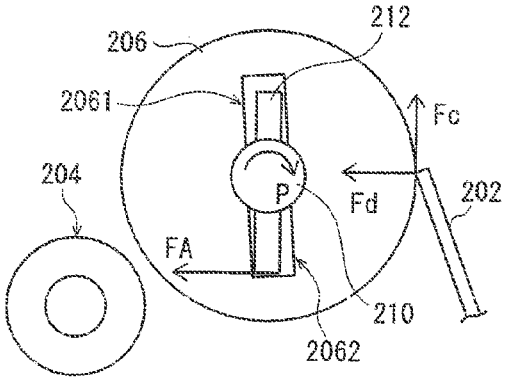
FIG. 8D Prior Art
Figure 8E:
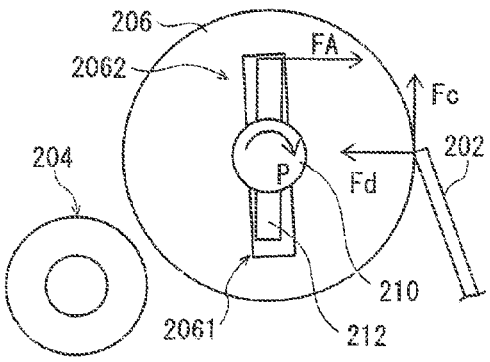
FIG. 8E Prior Art

FIG. 7B is an illustration of a flange member 84 and the parallel pin 76, viewed in a direction along the axial center X of the drum shaft 68, illustrated in the same way as FIG. 5A.

In embodiment 4, the flange member 84 is formed without grooves, and instead, a cylindrical portion 841P and a cylindrical portion 842P are provided perpendicular to a surface 84S of the flange member 84. The surface 84S faces away from the center of the photoreceptor drum 22. The cylindrical portions 841P and 842P form the contact portions that contact with the circumferential surface of the parallel pin 76.

The cylindrical portions 841P and 842P are formed having point symmetry with respect to the axial center X.

When the drum shaft 68 is rotationally driven in the direction indicated by an arrow R in FIG. 7B, the area of the circumferential surface of the parallel pin 76 at the first end portion 761 contacts and pushes against the cylindrical portion 841P and the area of the circumferential surface of the parallel pin 76 at the second end portion 762 contacts and pushes against the cylindrical portion 842P.

Since a pushing force thus generated is a coupled force about the axial center X, an effect identical to the effect described in embodiment 1 is obtained.

A cylindrical portion 843P and a cylindrical portion 844P are for restricting movement of the parallel pin 76 in the longitudinal direction thereof, and exhibit the same function as the end walls 741C and 742C in embodiment 1 (refer to FIG. 5C).

Also, a cylindrical portion 845P and a cylindrical portion 846P are for, when the parallel pin 76 moves in the longitudinal direction thereof, restricting a rotation angle of the parallel pin 76 relative to the cylindrical portions 841P and 842P, such that the end surfaces of the parallel pin 76 contact the cylindrical portions 843P and 844P.

Explanation is given above based on embodiments of the present invention. However, the present invention is of course not limited to the above embodiments, and modifications such as those described below may be made.

(1) In the above embodiments, the parallel pin is used as the pin member that is inserted (with clearance) into the insertion hole of the drum shaft. However, the present invention is not limited in this way, and a spring pin may be used instead of the parallel pin and pressed into the insertion hole of the drum shaft.

In such a case, when pressing the spring pin into the insertion hole of the drum shaft, it suffices that both end portions of the spring pin protrude by roughly the same lengths from the drum shaft. Thus, ease of assembly is not greatly reduced. In this case, roughly the same lengths means lengths adjusted such that, in a state in which the spring pin is inserted into the drum shaft, cylindrical surfaces of both end portions of the spring pin contact corresponding protrusion portions.

Also, when using the spring pin, since the spring pin does not move in a longitudinal direction thereof, regulation of the distance between the end walls described above and denoted by L1 (refer to FIG. 5C) becomes unnecessary, and the cylindrical portions 843P and 844P (refer to FIG. 7B) pertaining to embodiment 4, become unnecessary.

(2) In the above embodiments, explanation is given of the photoreceptor drum as the cylindrical member to which rotary power is transmitted. However, the cylindrical member is not limited to being the photoreceptor drum and may be the developing sleeve used in the developing device. Alternatively, the cylindrical member may be the fixing roller used in the fixing device.

(3) Also, it suffices that the parallel pin has a straight portion that can simultaneously contact a pair of the contact portions, which have point symmetry with respect to the axial center X of the drum shaft. Thus, the parallel pin does not have to have a circular shape in a transverse section thereof.

(4) In the above embodiments, explanation is given of the printer. However, the present invention may be applied to other image forming devices, for example copying machines, facsimile machines, or multifunction devices, etc., that have copying and facsimile functions.

SUMMARY

The above embodiment and modifications indicate one aspect for solving the technical problem explained in the Description of the Related Art, and a summary of the above embodiment and modifications is given below.

A first aspect of the present invention is a rotary power transmission mechanism, comprising: a cylindrical member; a flange member fitted to one end portion of the cylindrical member, and having a through hole passing through a center of the flange member; a shaft inserted through the through hole, and having an insertion hole passing through a radial direction of the shaft, rotary power of the shaft being transmitted to the cylindrical member via the flange member; and a pin member inserted through the insertion hole and having two end portions, which are portions of the pin member that protrude from opposite sides of the shaft, wherein the flange member has a pair of contact portions that have point symmetry with respect to an axial center of the shaft, the pair of contact portions being composed of a first contact portion and a second contact portion, and when the pin member is rotated in one direction by the shaft rotating in the one direction, the first contact portion contacts and is pushed by a first end portion of the pin member and the second contact portion contacts and is pushed by a second end portion of the pin member, the first end portion being one of the two end portions and the second end portion being the other one of the two end portions, and the pin member, when rotating in the one direction, pushes against the first contact portion and the second contact portion, rotates the flange member in the one direction, and thereby transmits rotary power to the cylindrical member.

In the rotary power transmission mechanism pertaining to the first aspect of the present invention, the flange member may have a first groove and a second groove extending in opposite radial directions with respect to the shaft, the first groove and the second groove each having a width greater than a diameter of the pin member, the first end portion and the second end portion of the pin member may be, in a radial direction of the pin member, at least half inside the first groove and the second groove, respectively, and the first contact portion may be a portion of one side wall of the first groove and the second contact portion may be a portion of one side wad of the second groove.

In the rotary power transmission mechanism pertaining to the first aspect of the present invention, when the first end portion and the second end portion push against the first contact portion and the second contact portion, respectively, and thereby transmit rotary power to the flange member, the rotary power transmission mechanism may be configured such that the pin member is not in contact with a side wall of the first groove opposite the first contact portion, and the pin member is not in contact with a side wall of the second groove opposite the second contact portion.

In the rotary power transmission mechanism pertaining to the first aspect of the present invention, the pin member may be a parallel pin inserted through the insertion hole, and a length of the parallel pin, a distance between an end wall of the first groove and an end wall of the second groove, and a position of the pair of contact portions relative to each other may be determined such that, when the parallel pin moves in a longitudinal direction thereof and one of two end surfaces of the parallel pin contacts the end wall of the first groove or the end wall of the second groove, contact is maintained between the parallel pin and one of the first contact portion and the second contact portion corresponding to the other one of the two end surfaces.

In the rotary power transmission mechanism pertaining to the first aspect of the present invention, the pin member may be a spring pin that is pressed into the insertion hole.

In the rotary power transmission mechanism pertaining to the first aspect of the present invention, the first contact portion and the second contact portion may each be a protrusion portion, the protrusion portion being a protrusion of the side wall of the corresponding one of the first groove and the second groove, and a tip portion of the protrusion portion may contact the pin member.

In the rotary power transmission mechanism pertaining to the first aspect of the present invention, the protrusion portion may have a ridge shape that is elongated in a depth direction of the corresponding one of the first groove and the second groove.

In the rotary power transmission mechanism pertaining to the first aspect of the present invention, the first groove and the second groove may each include a stepped portion formed in the side wall thereof and the first contact portion may be a protruding corner portion of the stepped portion of the first groove and the second contact portion may be a protruding corner portion of the stepped portion of the second groove.

In the rotary power transmission mechanism pertaining to the first aspect of the present invention, the side wall of the first groove and the side wall of the second groove may each have a mountain shape that is elongated in a depth direction of the corresponding one of the first groove and the second groove, the mountain shape having a ridge portion, and the first contact portion, and the second contact portion may each be the ridge portion of the mountain shape.

In the rotary power transmission mechanism pertaining to the first aspect of the present invention, a length of the pin member and positions of the pair of contact portions may be set such that the first contact portion contacts the first end portion, and the second contact portion contacts the second end portion, at positions that are each closer, in a longitudinal direction of the pin member, to a corresponding one of two end surfaces of the pin member than a center of the pin member.

In the rotary power transmission mechanism pertaining to the first aspect of the present invention, a portion of the flange member may be inserted into the cylindrical member, forming an insertion area, and the first contact portion and the second contact portion may be within the insertion area, and the pin member may contact the first contact portion and the second contact portion within the insertion area.

A second aspect of the present invention is a photoreceptor drum device used in an image forming device that forms an image by an electrophotographic method, comprising: a photoreceptor drum; a shaft that passes through the photoreceptor drum, an axis of the shaft coinciding with an axis of the photoreceptor drum; and a rotary power transmission mechanism that transmits rotary power from the shaft to the photoreceptor drum, wherein the rotary power transmission mechanism is the rotary power transmission mechanism pertaining to the first aspect of the present invention.

A third aspect of the present invention is a developing device used in an image forming device that forms an image by an electrophotographic method, comprising: a developing sleeve; a shaft that passes through the developing sleeve, an axis of the shaft coinciding with an axis of the developing sleeve; and a rotary power transmission mechanism that transmits rotary power from the shaft to the developing sleeve, wherein the rotary power transmission mechanism is the rotary power transmission mechanism pertaining to the first aspect of the present invention.

A fourth aspect of the present invention is a fixing device used in an image forming device that forms an image by an electrophotographic method, comprising: a fixing roller; a shaft that passes through the fixing roller, an axis of the shaft coinciding with an axis of the fixing roller; and a rotary power transmission mechanism that transmits rotary power from the shaft to the fixing roller, wherein the rotary power transmission mechanism is the rotary power transmission mechanism pertaining to the first aspect of the present invention.

A fifth aspect of the present invention is an image forming device that forms an image by an electrophotographic method and includes a photoreceptor drum device, wherein the photoreceptor drum device is the photoreceptor drum device pertaining to the second aspect of the present invention.

A sixth aspect of the present invention is an image forming device that forms an image by an electrophotographic method and includes a developing device, wherein the developing device is the developing device pertaining to the third aspect of the present invention.

A seventh aspect of the present invention is an image forming device that forms an image by an electrophotographic method and includes a fixing device, wherein the fixing device is the fixing device pertaining to the fourth aspect of the present invention.

According to the rotary power transmission device configured as described above, since the first contact portion and the second contact portion upon which the first end portion and the second end portion of the pin member push against are positioned so as to have point symmetry with respect to the axial center of the shaft, the pushing force when the shaft is rotated is a coupled force about the axial center, which acts on the flange member. Since the pushing force exerted on the flange member by the pin member is a coupled force, the force works entirely to rotate the flange member about the axial center, causing hardly any eccentricity in the rotation of the flange member with respect to the axial center. Thus, the present invention suppresses shifting of the cylindrical member to a greater extent than the conventional technology described above.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A rotary power transmission mechanism, comprising:

a cylindrical member configured to rotate in one direction;

a flange member fitted to one end portion of the cylindrical member, and having a through hole passing through a center of the flange member;

a shaft inserted through the through hole, and having an insertion hole passing through a radial direction of the shaft, rotary power of the shaft being transmitted to the cylindrical member via the flange member; and a pin member inserted through the insertion hole and having two end portions, which are portions of the pin member that protrude from opposite sides of the shaft, wherein the flange member has a pair of contact portions that have point symmetry with respect to an axial center of the shaft, the pair of contact portions being composed of a first contact portion and a second contact portion, and when the pin member is rotated in the one direction by the shaft rotating in the one direction, the first contact portion contacts and is pushed by a first end portion of the pin member and the second contact portion contacts and is pushed by a second end portion of the pin member, the first end portion being one of the two end portions and the second end portion being the other one of the two end portions, the pin member, when rotating in the one direction, simultaneously pushes against the first contact portion and the second contact portion, to rotate the flange member in the one direction, and thereby transmits rotary power to the cylindrical member, and the pair of contact portions protrude toward the in member.

2. The rotary power transmission mechanism of claim 1 wherein the flange member has a first groove and a second groove extending in opposite radial directions with respect to the shaft, the first groove and the second groove each having a width greater than a diameter of the pin member, the first end portion and the second end portion of the pin member are, in a radial direction of the pin member, at least half inside the first groove and the second groove, respectively, and the first contact portion is a portion of one side wall of the first groove and the second contact portion is a portion of one side wall of the second groove.

3. The rotary power transmission mechanism of claim 2, wherein when the first end portion and the second end portion push against the first contact portion and the second contact portion, respectively, and thereby transmit rotary power to the flange member, the pin member is not in contact with a side wall of the first groove opposite the first contact portion, and the pin member is not in contact with a side wall of the second groove opposite the second contact portion.

4. The rotary power transmission mechanism of claim 2, wherein the pin member is a parallel pin inserted through the insertion hole, and a length of the parallel pin, a distance between an end wall of the first groove and an end wall of the second groove, and a position of the pair of contact portions relative to each other are determined such that, when the parallel pin moves in a longitudinal direction thereof and one of two end surfaces of the parallel pin contacts the end wall of the first groove or the end wall of the second groove, contact is maintained between the parallel pin and one of the first contact portion and the second contact portion corresponding to the other one of the two end surfaces.

5. The rotary power transmission mechanism of claim 2, wherein the pin member is a spring pin that is pressed into the insertion hole.

6. The rotary power transmission mechanism of claim 2, wherein the first contact portion and the second contact portion are each a protrusion portion, the protrusion portion being a protrusion of the side wall of the corresponding one of the first groove and the second groove, and a tip portion of the protrusion portion contacts the pin member.

7. The rotary power transmission mechanism of claim 6, wherein the protrusion portion has a ridge shape that is elongated in a depth direction of the corresponding one of the first groove and the second groove.

8. The rotary power transmission mechanism of claim 2, wherein the first groove and the second groove each include a stepped portion formed in the side wall thereof, and the first contact portion is a protruding corner portion of the stepped portion of the first groove and the second contact portion is a protruding corner portion of the stepped portion of the second groove.

9. The rotary power transmission mechanism of claim 2, wherein the side wall of the first groove and the side wall of the second groove each have a mountain shape that is elongated in a depth direction of the corresponding one of the first groove and the second groove, the mountain shape having a ridge portion, and the first contact portion and the second contact portion are each the ridge portion of the mountain shape.

10. The rotary power transmission mechanism of claim 1, wherein a length of the pin member and positions of the pair of contact portions are set such that the first contact portion contacts the first end portion, and the second contact portion contacts the second end portion, at positions that are each closer, in a longitudinal direction of the pin member, to a corresponding one of two end surfaces of the pin member than a center of the pin member.

11. The rotary power transmission mechanism of claim 1, wherein a portion of the flange member is inserted into the cylindrical member, forming an insertion area, and the first contact portion and the second contact portion are within the insertion area, and the pin member contacts the first contact portion and the second contact portion within the insertion area.

12. A photoreceptor drum device used in an image forming device that forms an image by an electrophotographic method, comprising:

a photoreceptor drum;

a shaft that passes through the photoreceptor drum, an axis of the shaft coinciding with an axis of the photoreceptor drum; and a rotary power transmission mechanism that transmits rotary power from the shaft to the photoreceptor drum, wherein the rotary power transmission mechanism is the rotary power transmission mechanism of claim 1.

13. An image forming device that forms an image by an electrophotographic method and includes a photoreceptor drum device, wherein the photoreceptor drum device is the photoreceptor drum device of claim 12.

14. A developing device used in an image forming device that forms an image by an electrophotographic method, comprising:

a developing sleeve;

a shaft that passes through the developing sleeve, an axis of the shaft coinciding with an axis of the developing sleeve; and a rotary power transmission mechanism that transmits rotary power from the shaft to the developing sleeve, wherein the rotary power transmission mechanism is the rotary power transmission mechanism of claim 1.

15. An image forming device that forms an image by an electrophotographic method and includes a developing device, wherein the developing device is the developing device of claim 14.

16. A fixing device used in an image forming device that forms an image by an electrophotographic method, comprising:

a fixing roller;

a shaft that passes through the fixing roller, an axis of the shaft coinciding with an axis of the fixing roller; and a rotary power transmission mechanism that transmits rotary power from the shaft to the fixing roller, wherein the rotary power transmission mechanism is the rotary power transmission mechanism of claim 1.

17. An image forming device that forms an image by an electrophotographic method and includes a fixing device, wherein the fixing device is the fixing device of claim 16.

* * * * *